US007392676B2

(12) United States Patent
Eden, Jr.

(10) Patent No.: US 7,392,676 B2
(45) **Date of Patent: *Jul. 1, 2008**

(54) KEY BLANK WITH PROJECTION

(75) Inventor: Charles W. Eden, Jr., Lewisville, NC (US)

(73) Assignee: Kaba Ilco Corp., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/701,687

(22) Filed: Feb. 2, 2007

(65) Prior Publication Data

US 2007/0220937 A1 Sep. 27, 2007

Related U.S. Application Data

(63) Continuation-in-part of application No. 10/909,567, filed on Aug. 2, 2004, now Pat. No. 7,181,941.

(51) Int. Cl.
*E05B 19/06* (2006.01)
*E05B 29/04* (2006.01)

(52) U.S. Cl. ..... 70/493; 70/409

(58) Field of Classification Search ..... 70/389, 70/390, 429, 409, 492–495, 419, 358, 378, 70/392, 405–407, DIG. 23
See application file for complete search history.

(56) References Cited

U.S. PATENT DOCUMENTS 4,235,086 A * 11/1980 Genakis ..... 70/494
4,450,699 A * 5/1984 Genakis ..... 70/494
4,667,495 A * 5/1987 Girard et al. ..... 70/398
4,823,575 A * 4/1989 Florian et al. ..... 70/358
5,016,455 A * 5/1991 Hennessy ..... 70/493
5,076,081 A * 12/1991 Boris, Jr. ..... 70/398
5,101,648 A * 4/1992 Kuster ..... 70/358
5,131,249 A * 7/1992 Baden et al. ..... 70/398
5,222,383 A * 6/1993 Fann et al. ..... 70/358
5,361,614 A * 11/1994 Metcalf ..... 70/389
5,533,369 A * 7/1996 Valdajos-Gallego ..... 70/493
5,839,308 A * 11/1998 Eizen et al. ..... 70/358
6,125,674 A * 10/2000 Aramburu ..... 70/358
6,257,033 B1 * 7/2001 Ziv-Av ..... 70/494
6,508,091 B1 * 1/2003 Donatini ..... 70/359
7,181,941 B2 * 2/2007 Eden, Jr. ..... 70/493

* cited by examiner

*Primary Examiner*—Lloyd A Gall
(74) *Attorney, Agent, or Firm*—Alix, Yale & Ristas, LLP

(57) ABSTRACT

A key blank for a cylinder lock comprising a bow 308, a blade longitudinally extending from the bow to a tip, and having a longitudinally extending upper edge 306 to be cut with coded bitting for mating with a tumbler stack of a cylinder lock. A projection 148 extends outwardly on the upper edge adjacent the bow, rising from longitudinally extending surfaces 318 at elevation $e_0$ below the elevation $e_1$ of the upper edge, and having a length parallel to the upper edge that is greater than a width transverse to the edge. The projection is interposed between a front edge portion 306 to be cut with the coded bitting and a back edge portion 310 extending to the bow at elevation $e_4$ above elevation $e_1$. The projection has cam surfaces converging longitudinally and transversely toward a nose 180 at elevation $e_3$ above elevation $e_1$. The back edge 310 has a notch 320 forming an arcuate shoulder spaced from the upper projection at an elevation $e_2$ above elevation $e_1$, to support the rim of an auxiliary pin while the projection is within a recess on the underside of the pin.

39 Claims, 15 Drawing Sheets

KEY BLANK WITH PROJECTION

RELATED APPLICATION

This is a continuation in part application under 35 U.S.C §120, of U.S. application Ser. No. 10/909,567 filed Aug. 2, 2004 for "Lock System With Improved Auxiliary Pin Tumbler Stack", now U.S. Pat. No. 7,181,941.

BACKGROUND

The present invention relates generally to pin tumbler-type cylinder locks and associated keys. More particularly, this invention is directed to enhancing the security afforded by cylinder locks and especially to enhancing the ability of such locks to resist operation by a key obtained from an unauthorized source.

U.S. Pat. No. 4,823,575 discloses a novel cylinder lock and an associated key. The patented key, in addition to conventional bitting, is provided with a pair of projections on the opposite edges of the blade. These projections perform the dual function of operating an auxiliary pin tumbler stack, to permit rotation of the key and plug relative to the shell, and retaining the key in the keyway. The unique manner of implementation of the key retention function also reduces key and lock wear when force is imparted to the inserted key to move the door in which the lock is installed. U.S. Pat. No. 4,823,575 depicts a key wherein the bitting is in the form of depressions formed in the key blade, i.e., the patent depicts a "Kaba" type key. It will be understood by those skilled in the art, however, that the patented invention is equally applicable to a key wherein the bitting is, again by way of example only, in the form of conventional serrations in one or both edges of the key blade. Additionally, the patent depicts a reversible key, i.e., a key wherein the bitting is symmetrical and the two projections are of substantially the same size and shape. It will also be obvious to those skilled in the art that the patented invention is applicable to a key and lock combination where the pin tumbler arrangement is not symmetrical and where the projections serve separate and discrete functions, i.e., one projection operates the auxiliary pin tumbler stack while the other projection is intended for key retention only.

The lock and key of U.S. Pat. No. 4,823,575 have enjoyed significant commercial success. The patented combination, however, lacks a capability which many purchasers of high security locks desire. This capability is known in the art as "trapping". With trapping capability, should an attempt be made to operate a lock with an unauthorized key, such key is captured in the lock if the attempt to rotate the plug relative to the shell proves successful. A "trapped" key may not be withdrawn from the keyway without disassembly of the lock and trapping will prevent further plug rotation.

U.S. Pat. No. 5,016,455 is directed to an improvement to the lock and associated key of U.S. Pat. No. 4,823,575 and particularly adds a trapping function. The cylinder lock is characterized by two separate parting lines, and particularly two shear lines located at different radial distances from the axis of the shell. The primary pin tumbler stacks are associated with a first of these parting lines while an auxiliary pin tumbler stack is associated with the second parting line. The second parting line is located at a greater radial distance from the cylinder lock axis than the first parting line. The shell of the lock has portions of at least two different diameters, commensurate with the two parting lines, and the plug has a shape which is, in two portions, complementary in shape to the shell. A circumferential retaining groove is formed in that portion of the shell which is associated with the auxiliary pin tumbler stack. A longitudinal slot or recess having the same depth as the groove communicates between the forward end of the shell and the groove. An associated key has, in addition to conventional bitting for operating the primary pin tumbler stacks, a pair of projections extending from the opposed edges of the key blade. These projections are, at least in part, in alignment. A first projection causes translation of the auxiliary pin tumbler stack to permit rotation of the plug relative to the shell. The second projection is longer than the first projections and will pass along the longitudinal slot to engage the groove to retain the key in the plug subsequent to rotation thereof. The second projection also cooperates with the drive pin of the auxiliary pin tumbler stack, upon rotation of the plug by 180 degrees, to prevent the driver pin from engaging the keyway in the plug, such engagement trapping the key and disabling the lock.

SUMMARY

There present invention is an improvement in the key and key blank over the lock and key described in U.S. Pat. No. 5,016,455, the disclosure of which is hereby incorporated by reference, and the key and key blank described in U.S. application Ser. No. 10/909,567 filed Aug. 2, 2004 for "Lock System With Improved Auxiliary Pin Tumbler Stack" (hereinafter referred to as the "parent application").

According to the present disclosure, the bottom pin of the auxiliary stack has a recessed underside for receiving a projection on the key to form a detent.

During insertion of the key in the keyway, the key projection cams and displaces the bottom pin to align the shear line between the bottom pin and the drive pin, with the shear line between the plug and the shell, at the location of the auxiliary stack. The key projection enters the recess. An improperly manufactured key blank will not displace the bottom pin the correct distance, and thus not effectuate the correct alignment of the shear lines, so the plug cannot be fully rotated to operate an associated latch or the like.

The focus of the present disclosure is on a key blank comprising a bow, a blade longitudinally extending from the bow to a tip, and having a longitudinally extending upper edge to be cut with coded bitting for mating with a tumbler stack of a cylinder lock. A projection extends outwardly on the upper edge adjacent the bow, rising from longitudinally extending surfaces at an elevation below the elevation of the upper edge, and having a length parallel to the upper edge that is greater than a width transverse to the edge. The projection is interposed between a front edge portion to be cut with the coded bitting and a back edge portion extending to the bow. The projection has cam surfaces converging longitudinally and transversely toward a nose.

In one aspect, the projection has a convexly contoured longitudinal cam surface facing the tip of the blade and a convexly contoured longitudinal cam surface facing the bow, which converge toward a nose. Most preferably, the longitudinal cam surfaces and transverse cam surfaces define an annular portion of a hemisphere immediately below the nose. The longitudinal cam profile smoothly lifts the pin during insertion and withdrawal of the key from the key way, and the transverse profile enables the projection to fully enter and center within the recess in the auxiliary bottom pin even in when slightly initially misaligned. The projection is milled as a step in the manufacture of the key blank.

In another aspect, the back edge has a notch forming an arcuate shoulder spaced from the upper projection at an elevation to support the rim of the auxiliary pin bottom while the projection is within the recess on the underside of the pin.

Providing a shoulder in conjunction with the projection, adds another level of security, because a key made from a blank that does not have the correct relationship among the projection location, height, length and the shoulder location, height, and width, will not operate satisfactorily.

BRIEF DESCRIPTION OF THE DRAWINGS

The present disclosure may be readily understood, and its numerous objects and advantages will become apparent to those skilled in the art, by reference to the accompanying drawings wherein like reference numerals refer to like elements in the figures and wherein.

DETAILED DESCRIPTION

The context of the disclosure will be described with reference to the known lock and key system shown in FIG. 1, whereas the particular inventive features will be described with respect to FIGS. 2-18.

Figure 1:
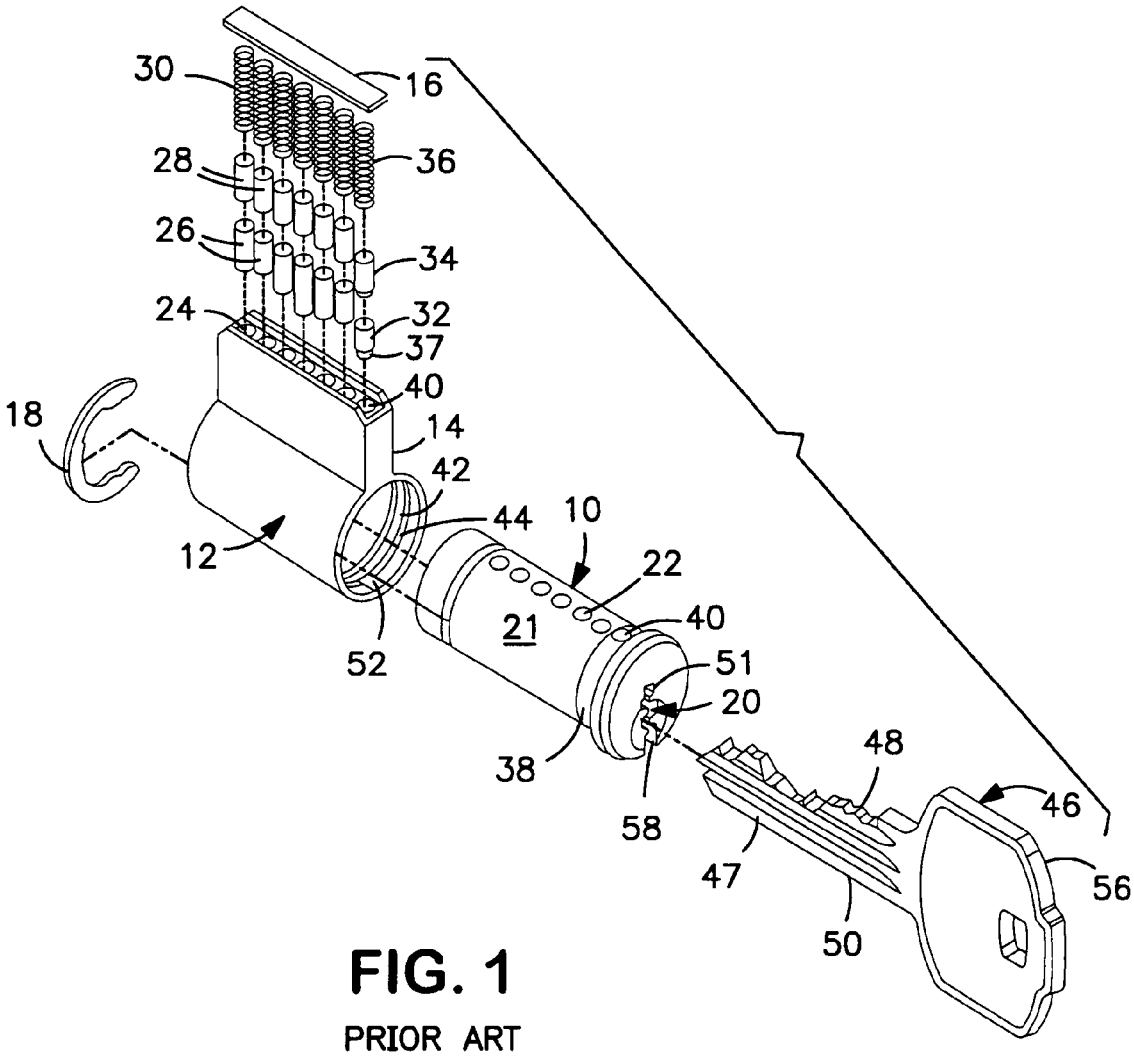
FIG. 1 PRIOR ART
FIG. 1 is an exploded perspective view of a cylinder lock and key according to U.S. Pat. No. 5,016,455.

The cylinder lock system shown in FIG. 1 includes a plug and a shell, respectively indicated generally at 10 and 12. The lock is of the type known in the art as a "bible" lock, i.e., the single row of pin tumbler stacks with their associated biasing springs are received in chambers provided in a generally rectangular projection 14 which extends from shell 12. The pin tumbler stacks and springs are retained in the "bible" 14 by means of a plate 16, the plate 16 being affixed to the bible 14 in any suitable manner. The plug 10 is captured in the shell 12 by means of a spring-loaded lock ring 18.

It is to be understood that such construction exemplifies that employed in conventional cylinder locks, wherein the plug 10 is provided with a keyway, indicated generally at 20, and has a cylindrical intermediate portion 21 in which a spaced row of bores 22 are formed. The bores or pin chambers 22 extend inwardly to intersect the keyway. The "bottom" pins 26 of the primary pin tumbler stacks are received in chambers 22. With the lock in the locked condition, the individual chambers 22 of the linear array of pin chambers in plug 10 will each be aligned with a bore which defines a pin tumbler chamber 24 in bible 14. Chambers 24 receive the driver pins 28 of the primary pin tumbler stacks. In the disclosed embodiment each of the primary pin tumbler stacks comprises a "bottom" pin 26, a "top" or driver pin 28 and a biasing spring 30. When the lock is in the locked condition, and a proper key is not inserted in the keyway 20 in plug 10, the spring biased driver pins 28 are positioned such that they extend across the shear line between the plug and shell and rotation of the plug relative to the shell is thus prevented. Insertion of a proper key results in translation of the pin tumbler stacks to place the interface or shear line between the bottom and driver pins at the shear line between the plug and shell and rotation of the plug with the bottom pins is possible.

Figure 2:
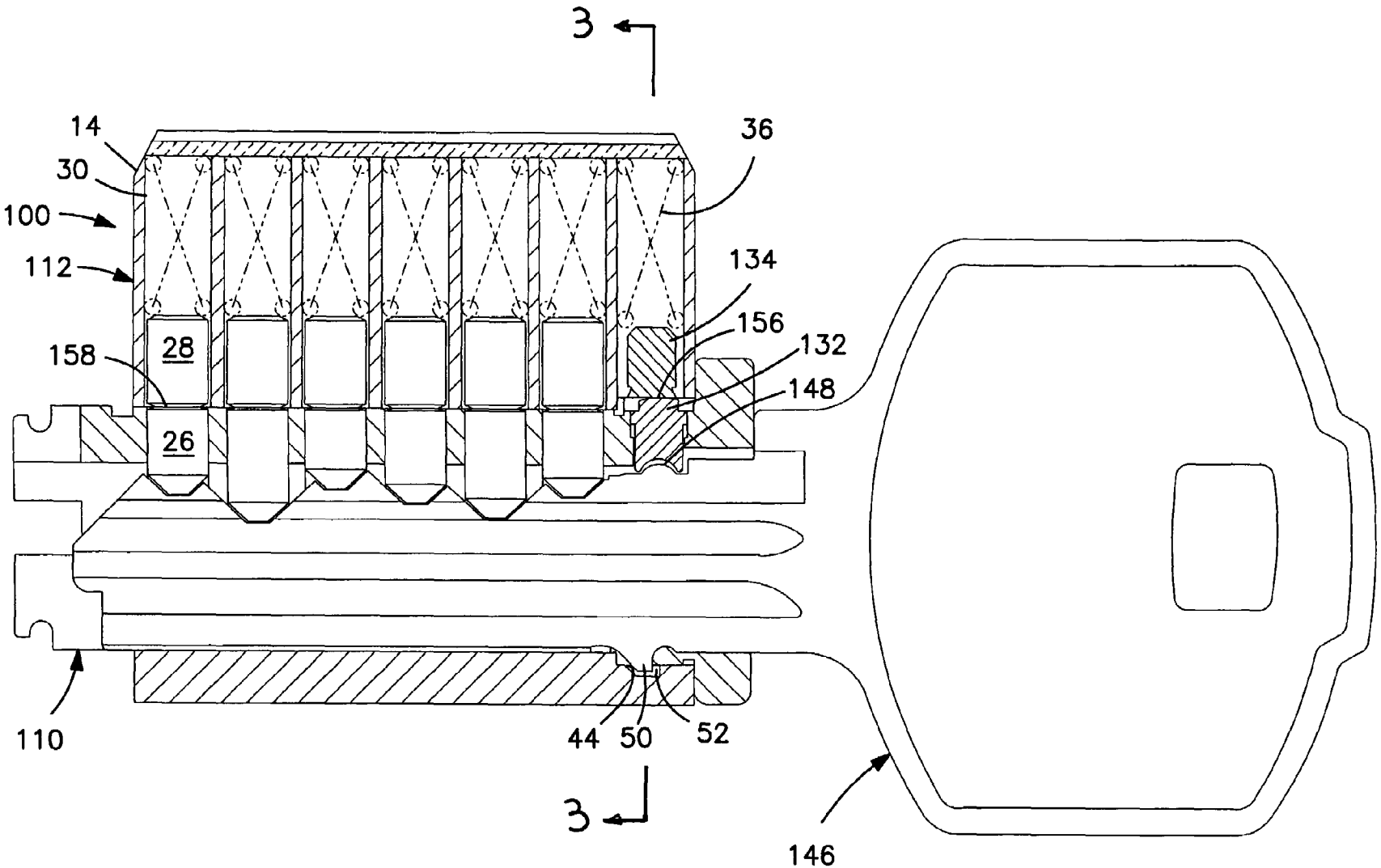
FIG. 2 is a cross-sectional, side elevational view of the present invention, showing the improvements relative to the lock and key of FIG. 1, the key not being shown in cross-section in FIG. 2 in the interest of facilitating understanding of the invention.

The lock is provided with an auxiliary pin tumbler stack, which comprises a bottom pin 32, a driver pin 34 and a biasing spring 36. The plug 10 is provided with a forwardly disposed cylindrical portion 38 of increased diameter relative to the cylindrical intermediate portion 21 in which the pin chambers 22 are formed. The chamber 40, which receives the bottom pin 32 of the auxiliary pin tumbler stack, is formed in enlarged diameter portion 38 of the plug and, as with chambers 24, extends inwardly to intercept the keyway. The shell 12 is provided with a recess 42 which is complementary in size and shape to, and which thus receives, the enlarged diameter portion 38 of plug 10. Recess 42 extends inwardly from the forwardly facing end of shell 12 to a stop or guide shoulder. A circumferential groove 44 is provided intermediate the width of recess 42. Groove 44, as may be seen from FIG. 2, is defined by a front shoulder, which extends generally radially with respect to the axis of the cylindrical shell, and an angled rear surface.

The key 46 is provided with bitting on the upper edge of blade 47, and a pair of oppositely disposed projections, which extend from the edges. The bitting in the disclosed embodiment is in the form of a conventional sawtooth cut. In the case of the "bible" lock that has been depicted for purposes of explanation, the bitting is on a single edge of the key. The projections are indicated at 48 and 50. The projection 48 operates, i.e., cams, the auxiliary pin tumbler stack when the key is inserted in the plug keyway. Projection 48 is provided with angularly oriented cam surfaces on all four sides and may, again by way of example, have a truncated pyramidal shape. The key blade 47 is provided with a longitudinally extending undercut, not shown, which results in one side of projection 48 extending outwardly from the base of the cut and then inwardly to its top surface. Keyway 20 is provided with an upper portion 51 shaped and sized to receive projection 48. When compared to a conventional lock, in order to accommodate projection 48, the keyway 20 is of extended height for a portion of its length, which extends across the auxiliary pin tumbler receiving bore 40. As noted above, that portion of keyway 20 that is of extended height is also shaped as necessary to accommodate the projection 48.

In the conventional manner, the keyway 20 extends through the bottom of plug 10 as shown at 58. The shell 12 is provided, extending inwardly from the forwardly facing edge thereof, with a recess 52 that receives the projection 50 on the key blade. Recess 52 is oriented transversely with respect to the front shoulder of groove 44 and terminates at a point located inwardly beyond the intersection of the recess with groove 44.

According to the present inventor's parent application, the bottom pin 32 of the auxiliary pin tumbler stack and the associated projecting cam 48 shown in FIG. 1, are redesigned as shown in FIGS. 2-11. The redesigned bottom pin 32 is identified by numeric identifier 132 and the redesigned cam projection is identified by numeric identifier 148. Preferably, the driver pin 34 is also redesigned, as indicated by numeric identifier 134. This driver pin 134 can be of smaller diameter than the other driver pins in the bible, to assure that the pin will cross the shear line if an unauthorized key is used to rotate the plug within the shell, as described below.

A significant aspect is that the lower surface 150 of the bottom pin 132 has a recess, such as a concave cavity, for receiving and seating the projecting convex cam 148 on the key. This is evident in FIGS. 3 and 9, where a properly milled projection 148 is received within the pin 132, such that the interface between the top surface 152 of the pin 132 and the bottom surface 154 of the drive pin 134 is at the shear line 156 between the plug 110 and the shell 112. As shown in FIG. 2, this shear line 156 for the auxiliary stack is preferably at a greater diameter than the shear line 158 for the remainder of the stacks in the bible 14. Moreover, the axis of the auxiliary bore or chamber of the drive pin 134 is slightly offset from the axis of the bore or chamber of the bottom pin 132 (and the center of the projection 148 of the key) along the plug axis direction, such that the centerline 160 of the bottom pin 132 and the projection 148 are nominally aligned but offset from the centerline of the drive pin 134. This provides additional flexibility in designing a lock/key combination that is resistant to unauthorized access, provided the chambers and pins are sized and or shaped to accommodate each other when activated by a properly milled key.

Figure 3:
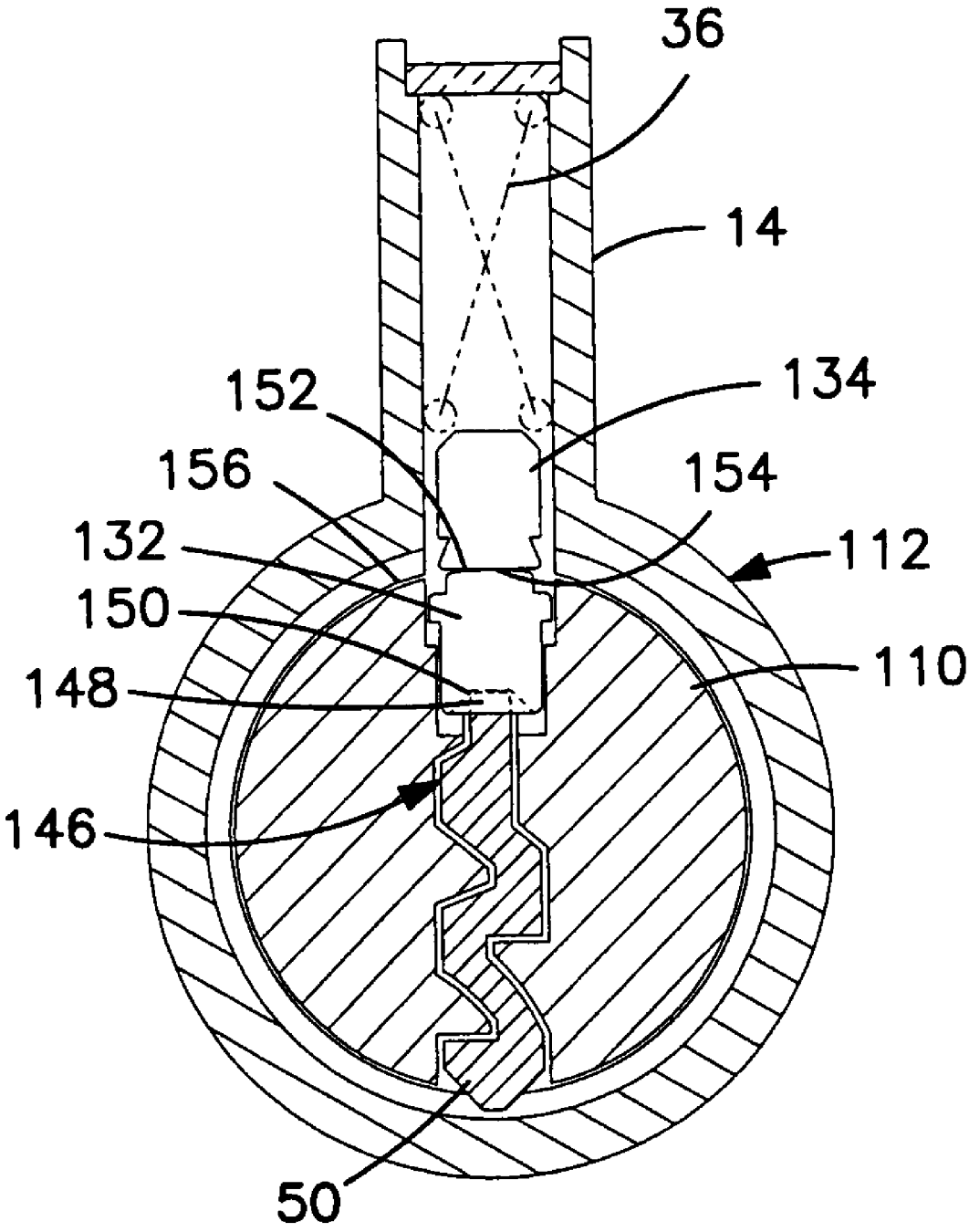
FIG. 3 is a cross sectional view along line 3-3 of FIG. 2, showing a properly milled key in the neutral position.
Figure 4:
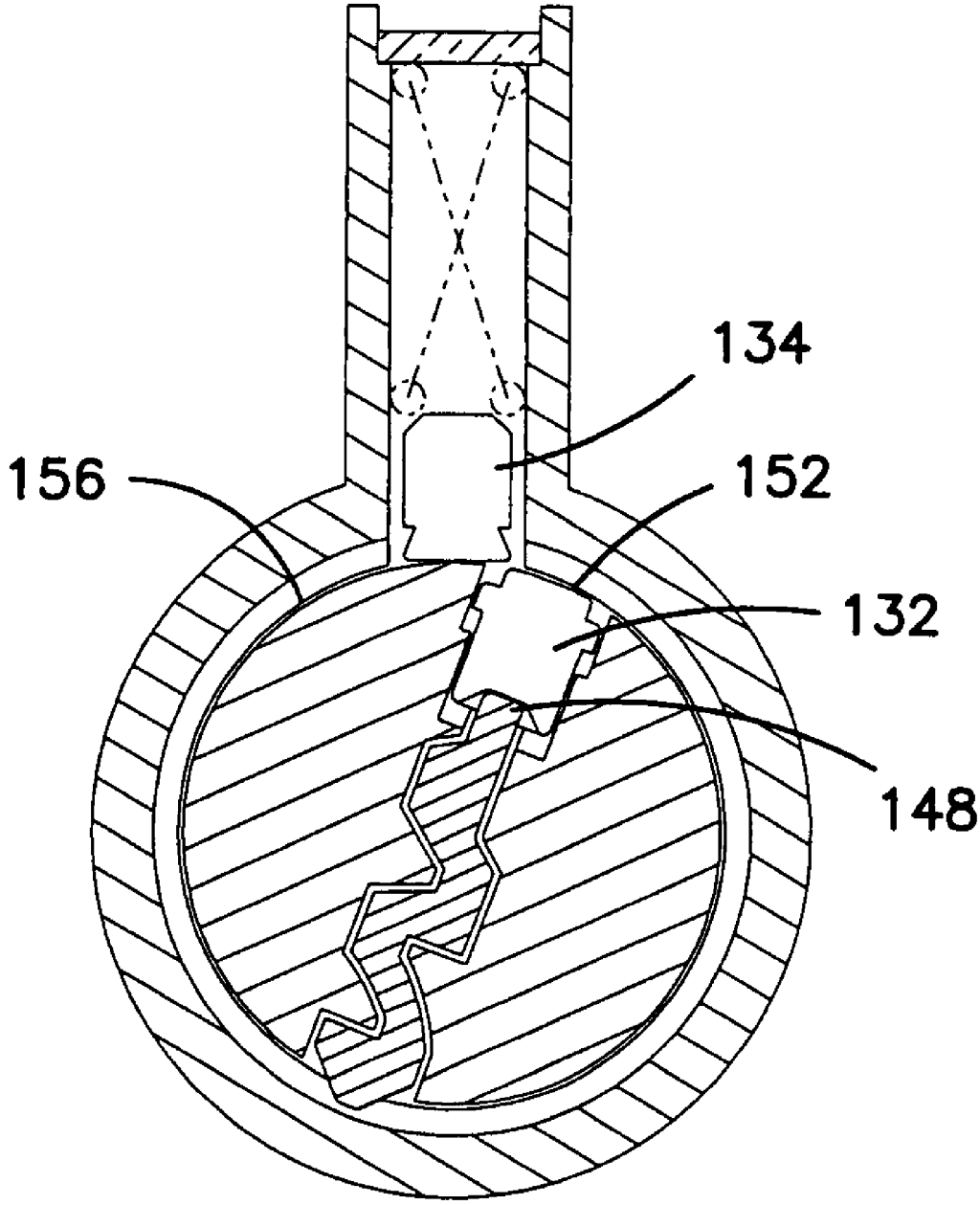
FIG. 4 is a cross sectional view of the lock and key of FIG. 3, with the key rotated slightly clockwise, yet maintaining a clear shear line that permits further rotation.
Figure 5:
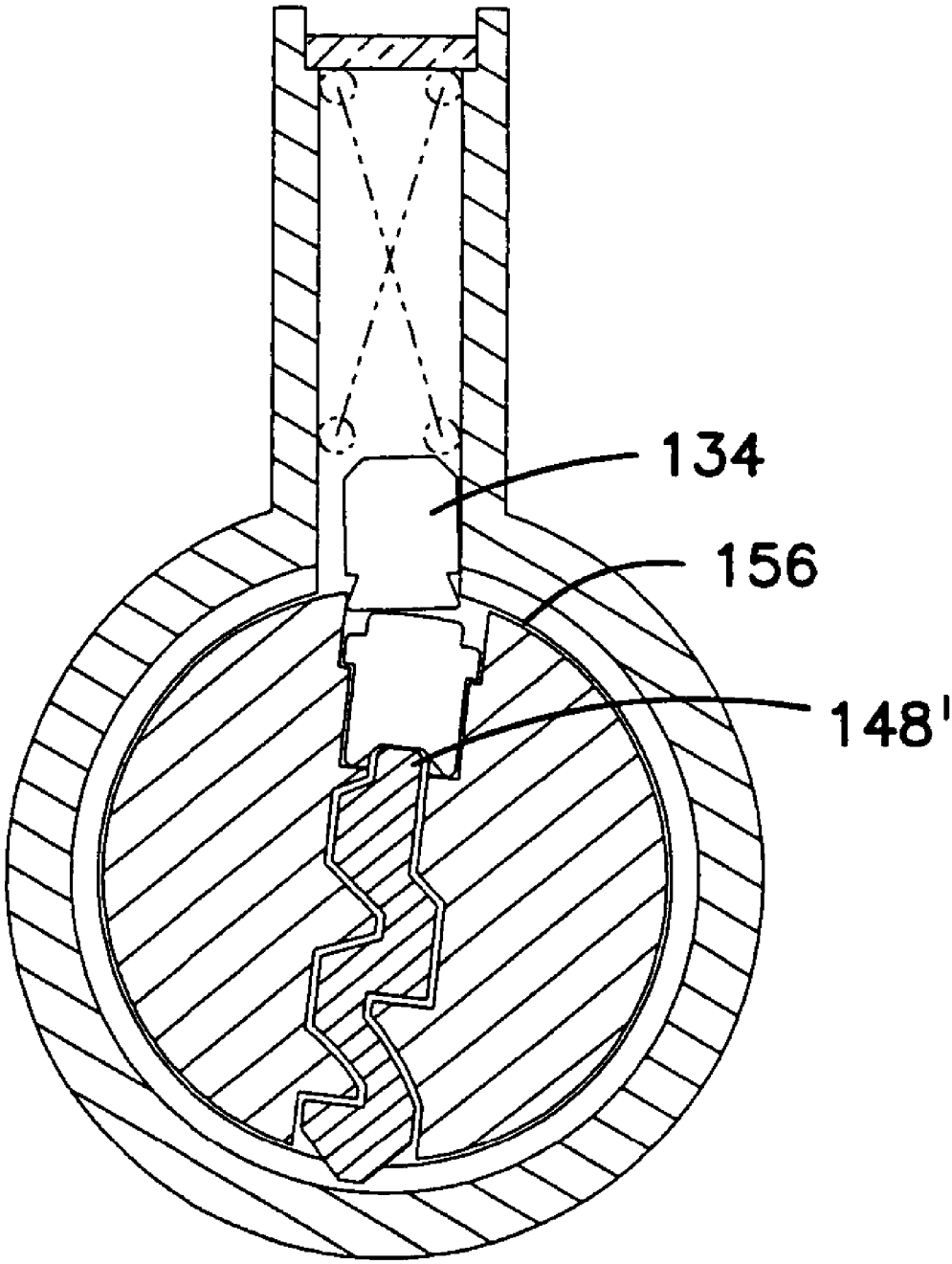
FIG. 5 is a cross sectional view of the lock of FIG. 2, but with a first type of improperly milled key rotated slightly clockwise, whereby the shear line is crossed, thereby preventing further rotation and trapping the key.
Figure 6:
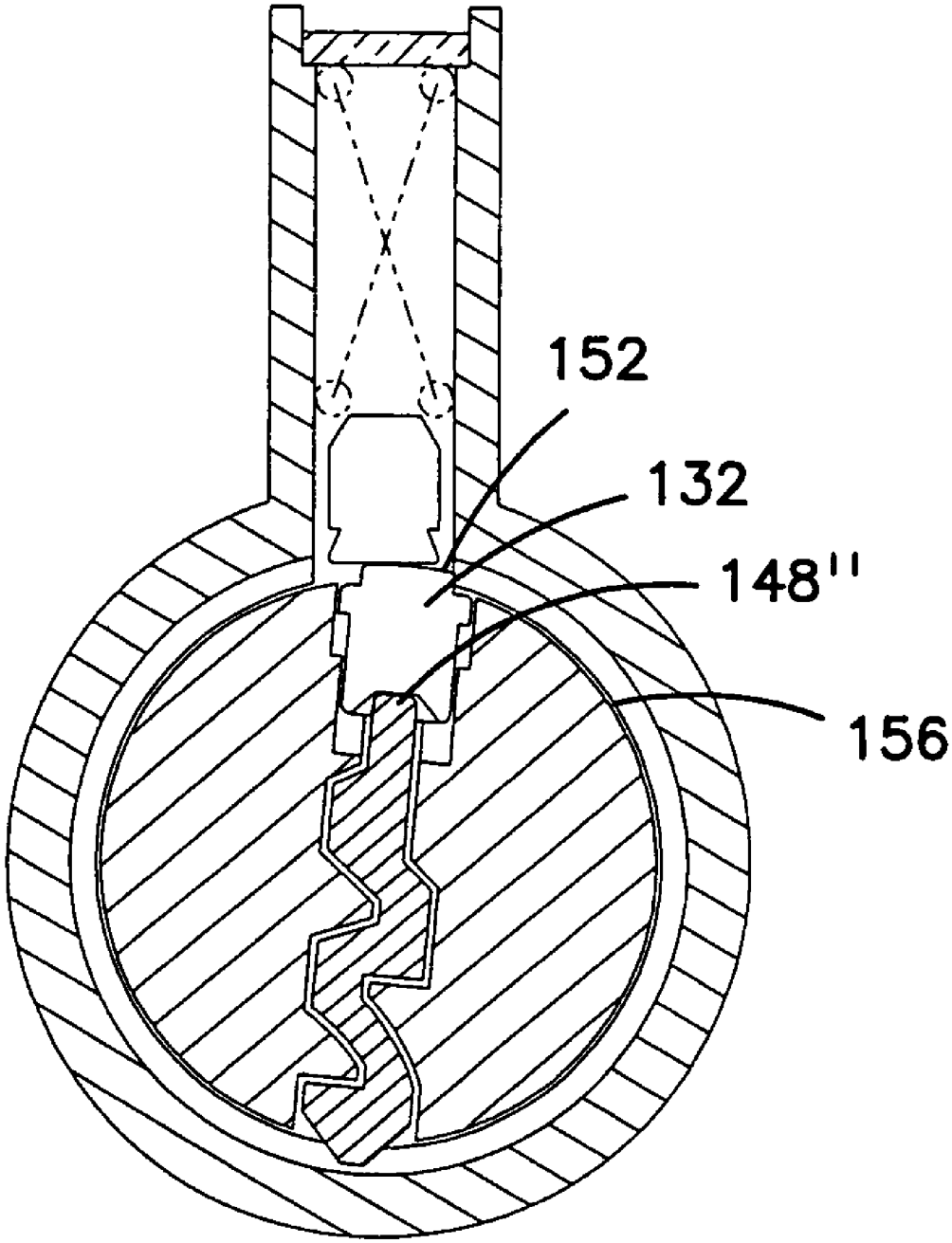
FIG. 6 is a cross sectional view of the lock of FIG. 2, but with a second type of improperly milled key rotated slightly clockwise, whereby the shear line is crossed, thereby preventing further rotation and trapping the key.
Figure 9:
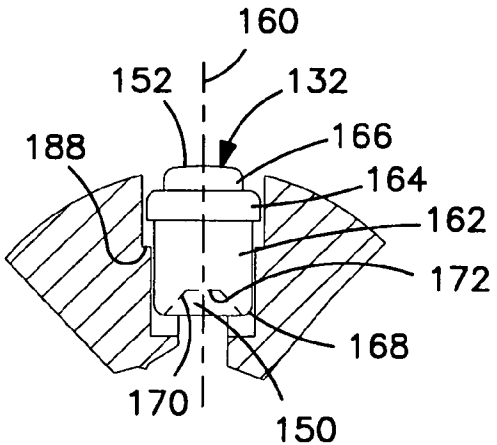
FIG. 9 is an elevation view of the hollow pin that interacts with the projecting compound cam on the key of FIG. 8.

As seen in section through the plug according to FIG. 3, the centerlines of the pins 132, 134 and projection 148 are preferably aligned. As shown in FIGS. 9 and 10, the bottom pin 132 has a cylindrical body 162 of a first outer diameter, an annular flange or rim 164 forming a shoulder, and a substantially cylindrical head portion 166 having a smaller outer diameter than the body portion. The head portion can be slightly rounded, whereas the bottom portion has a beveled edge 168 leading to a concave wall structure defining a recess or cavity 150. The recess could have any shape, even if irregular, that performs the functionality described herein. However, a cavity defining a hollow space that is two-way and preferably four-way symmetric about the pin centerline, most preferably in the shape of a truncated cone (frustoconical) is desirable, wherein the side surface 170 of the cavity forms an angle with the pin centerline, and the end wall 172 is substantially perpendicular to the centerline. Alternatively, no flange need be provided, if the pin body and associated chamber interact as shown in the incorporated U.S. Pat. No. 5,016,455.

Figure 7:
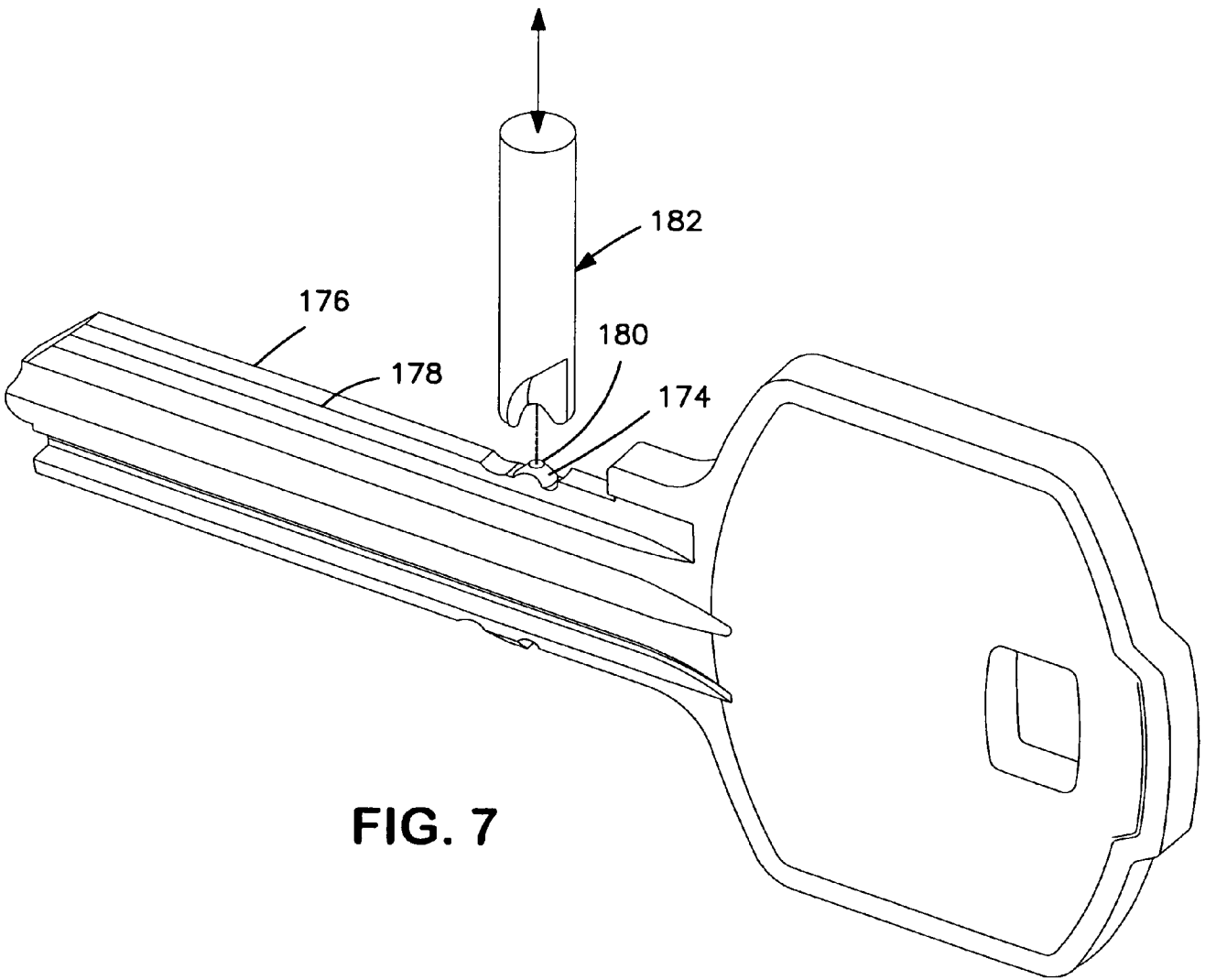
FIG. 7 is a perspective view of a key blank having the projecting compound cam according to the invention.
Figure 8:
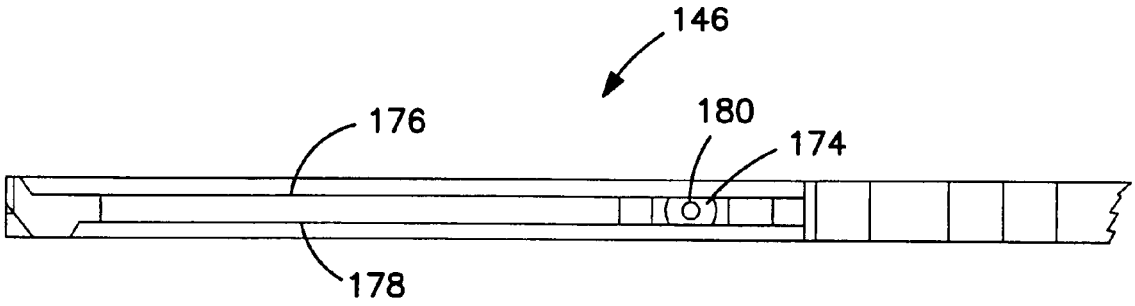
FIG. 8 is a view of the top edge of the key of FIG. 7.
Figure 10B:
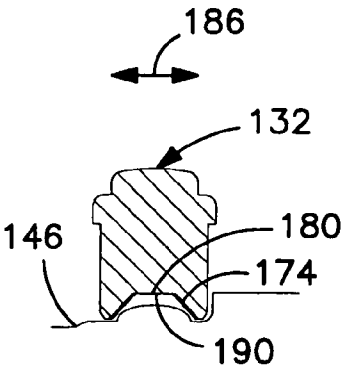
FIGS. 10A and 10B are partially sectioned views of the cam projection of the key situated within the cavity of the pin of FIG. 9, taken along two planes that are perpendicular to each other.
Figure 10A:
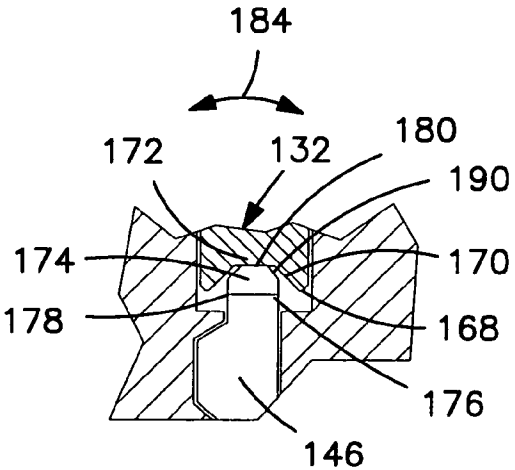

The projection 148 from the top edge of the key forms a compound convex profile, as shown in FIGS. 7, 8 and 10. The converging portion 174 of the projection is preferably defined by a substantially hemispherical, convex shape that is linearly truncated by the two parallel longitudinal corners 176, 178 of the top edge of the key. The central portion 180 of the projection is preferably flat. The longitudinal profile 174 as shown in FIG. 10B acts as a cam for the key to pass under the pin 132, whereas the transverse profile 190 as shown in FIG. 10A defines the shoulders of a narrowing, nose-like feature of the projection that can provide a transverse camming action to assure that the projection will enter into and fit within the cavity, even if there is slight misalignment of the center of the projection relative to the center of the pin 132.

The configuration may optionally include the lower projection 50 on the key and the associated groove in the shell, as shown in FIG. 1. The projection 50 is provided with an angled surface on the side that faces the blade tip and with cam surfaces on the two sides that face in the opposite directions of key rotation. The shape of the angled side of projection 50 which faces the blade tip is complementary to the angled, rearwardly disposed side of groove 44. Since projection 50 functions to retain the key in the keyway when the plug has been rotated from the locked position, in the disclosed embodiment projection 50 is provided with a flat surface on the side that faces the bow 56 of the key. This flat surface 54 which need not be provided on projection 48 since projection 48 does not extend into groove 44, cooperates with the front radially extending shoulder 52 that in part defines the groove 44. This cooperation results from the fact that projection 50 on the key blade is of greater height than projection 48. Restated, projection 50 is longer than the width, in the radial direction, of increased diameter portion 38 of plug 10 and projection 50 thus extends outwardly from the plug into the groove 44 in the shell. It is also to be noted that the lower portion 58 of the keyway, which accepts projection 50, may be of increased width when compared to the portion of the keyway that accepts the remainder of blade 47.

This key and lock combination provides two distinct key retention techniques, which operate in the following manner. Similarly to the known technique according to FIG. 1, upon insertion of a proper key 146 in the keyway 20, all of the pin tumbler stacks, including the auxiliary pin tumbler stack, will be translated to the positions shown in FIG. 2 where the shear lines between the driver and bottom pins register with the shear lines between the plug and shell. This unlocks the lock and permits rotation of the plug relative to the shell. During such rotation the forward facing surface on projection 50 on the key blade cooperates with the front shoulder of groove 44 to retain the key in the lock. When the plug has been rotated 180 degrees, the projection 50 will contact the substantially flat or slightly rounded solid lower surface of auxiliary driver pin 134 and will keep this pin in the raised position where it is shown in FIG. 2. If projection 50 were not present, when the plug was rotated by 180 degrees the lower end 37 of driver pin 34 would be forced by biasing spring 36 into the portion 58 of keyway 20 that extends through enlarged diameter portion 38 of the plug and any further rotation of the key, in either direction, would be prevented. Also, since the bottom pin tumblers could not move outwardly, the key would be trapped.

The lock according to the parent application provides security and an additional (or optionally alternative) key retention technique. The neutral position of the auxiliary stack resulting from insertion of a proper key 146 in the lock is shown in FIG. 3. The second portion of the plug and the second portion of the shell are annularly spaced apart by a radial clearance and the shear line between the auxiliary drive pin and the auxiliary bottom pin is within this clearance when the pins are in substantial alignment. Throughout rotation of the plug to the position shown in FIG. 4, the drive pin 134 remains supported by the top surface 152 of the bottom pin until support is transferred to the circumference of the plug, thereby keeping the shear line clear so that the plug may be further rotated to the unlocked position. However, if the projection on the key is too low, as shown at 148' in FIG. 5, the drive pin 134 drops below the shear line 156 into the plug, thereby blocking further rotation of the plug. Similarly, if the projection on the key is too high, as shown at 148" in FIG. 6, the top surface 152 of bottom pin 132 remains above the shear line 156, likewise blocking further rotation of the plug. In the normal condition where rotation is permitted, when the pins 132, 134 are out of substantial alignment as a result the relative rotation between the plug and shell, the inside surface of the second portion of the shell provides a stop limit on the radial displacement of the bottom pin 132 such that the key projection 180 cannot be fully withdrawn from the recess 150 in the bottom pin. In particular, the depth of the recess should be greater than the radial clearance between the plug and shell, so the projection 180 cannot be pulled out of the recess unless the auxiliary pins are substantially aligned.

FIG. 9 shows the exterior of the bottom pin in relation to the surrounding bore in the plug, and FIG. 10A shows a detailed view of the projection nose 180 properly mated with the cavity 150 in the bottom pin 132 (in a vertical section taken perpendicularly to the view of FIG. 9). The end wall 172 of the projection bears on the nose 180, whereas the bottom edges of the pin are slightly suspended above the base portion of the projection. The nose is substantially circular, and defines a flat surface parallel to the key top edge. Alternatively, the outer edges 168 could rest on the portion 174 or in the region of the edge surrounding the portion 174 without the nose 180 contacting the end wall 172 so long as the projection 148 is within the cavity a greater distance than the clearance between the plug and shell. When the key is rotated as indicated by directional arrow 184, the nose projection 148 remains in the cavity as the plug carries the bottom pin along by imparting the rotational force on the flange 164 and/or body 162. FIG. 10B is a vertical section corresponding to FIG. 9, with the longitudinal direction (i.e., direction of key insertion and removal) indicated by arrow 186. With no key in the keyway, the flange 164 rests on ledge 188 formed at the counterbore limit of the bottom pin bore. The exterior beveling 168 provides a lead-in ramp for the convex portion 174 of key projection 148 to initially raise the bottom pin 132 and then enter and seat against the end wall of the cavity 150 and, in essence, form a detent.

Preferably, the longitudinal dimension of the projection (profile 174) is less than the inner diameter of the cavity 150, so the projection can be received entirely within the cavity, or else the projection can have a longer base profile and projecting nose, with the outer edge of the cavity resting on a portion of the base and the nose entirely within the cavity (not shown). In FIG. 10B, the slopes of the longitudinal profile 174 have approximately the same angle as the angle of the cavity sidewall 170, and are slightly spaced from the sidewall but the pin 132 is vertically supported at the nose 180. As used herein, "detent" means the presence of all or part of a projection on one member into all or part of a recess in another member, whether or not seated. As used herein, "seating" is the condition wherein the projection bears against all or a portion of the inside of the recess.

It can be appreciated that the projection 148 preferably has a compound convex shape as viewed transversely between corners 176, 178 of the blade per FIG. 10A and longitudinally per FIG. 10B. However, other shapes that provide the desired longitudinal camming action may be used, even if the preferred transverse camming action is not provided.

FIG. 7 schematically shows how a milling tool 182 is applied to the upper edge of a key blank to form the compound convex projection having base portion 174 and nose portion 180, in a single, precise milling operation. The top of the nose 180 is at the same elevation as the top edge of the key blank, but after the key is coded with, e.g., a saw tooth bitting pattern (see FIG. 2), the top of the nose 180 will be the highest point on, or above, the top edge out to the tip of the blade.

When the user has locked or unlocked the lock and begins to remove the key from the keyway, the profile 174 of projection 148 as viewed along directional arrow 186 interacts with the slope of the cavity sidewalls 170 such that the sidewalls ride over the nose 180, whereby the projection 148 can be fully shifted away from the bottom pin 132. The bitting on the remainder of the top surface of the key will not enter the cavity because the greater diameter of the auxiliary shear line and the position of the ledge 188 keep the bottom pin high enough above the top edge of the key (key blank) such that even the highest point on any bit will either not contact the lower end of the bottom pin, or will ride on the external beveled edge 168 and sloped internal edge of the cavity. The slopes on the bitting can optionally be substantially equal to the slope of the cavity internal sidewall 170 so the bitting can enter the cavity a substantial distance yet slide past.

Unlike the interaction between the bottom 32 and drive 34 pins in the known configuration represented by FIG. 1, however, the invention provides for key retention by the auxiliary stack. With reference again to FIGS. 2, 3, and 4, it can be appreciated that shear line 156 between the drive pin 134 and bottom pin 132 exists only when the bottom pin 132 is fully or partially beneath the drive pin bore. With a proper key inserted, the plug can be rotated to operate the latch (not shown), whereby the top 152 of the bottom pin will closely confront the inner solid surface of the shell. If the user attempts to remove the key, the sidewall of the cavity will ride up on the nose, to contact the shell inner surface, which serves as a stop limit on the rise of the bottom pin. Unless the pin can rise a distance exceeding the height of the nose, the cavity entraps the nose, so the key cannot be further pulled out of the keyway. Only by counter rotating and realigning the bottom pin with the drive pin, can the bottom pin rise a sufficient distance to permit the sidewall to completely ride over the nose so the key can be removed.

Although the projection 50 of the incorporated patent provides a key retention function, this is achieved by the projection remaining in a groove 44 having a front shoulder 52 that prevents removal of the key unless the plug is in the neutral position so the projection aligns with slot 58. In contrast, with the present invention no special retention groove is necessary; rather, a detent-like interference is maintained between the projection 148 on the key and the cavity 150 in the underside of the bottom pin 132, for every rotational position of the plug except neutral. The retention function of the lower projection can be eliminated, or augmented. In this embodiment, the projection 148 can extend from the key upper edge a greater distance than the projection 50 extends from the lower edge.

Figure 11:
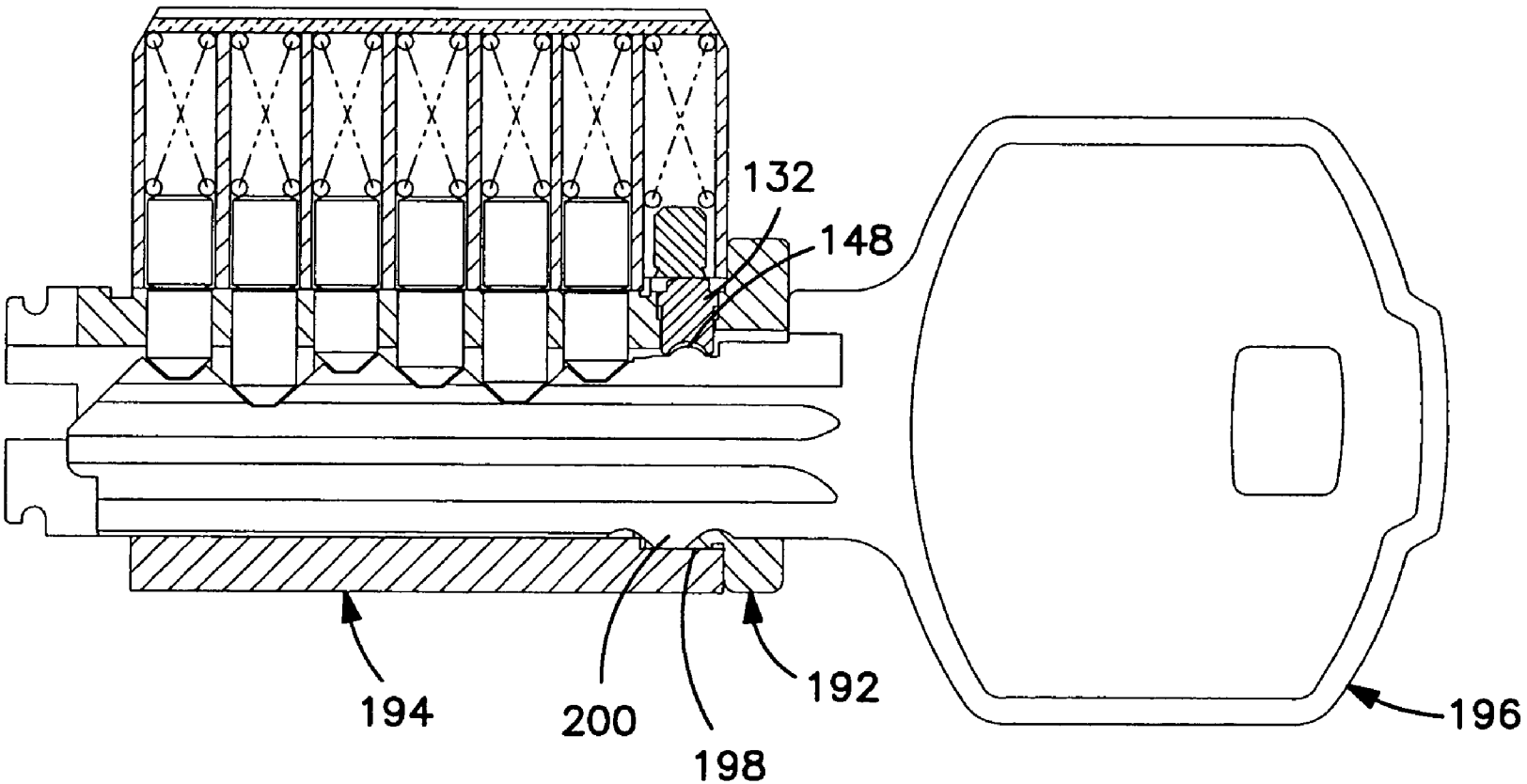
FIG. 11 is view similar to FIG. 2, showing an alternative embodiment wherein the key retention function is achieved only with the inventive auxiliary stack and associated cam projection on the top of the key blade.

FIG. 11 shows an alternative embodiment wherein the groove and associated key retention functionality of the lower projection are eliminated. The plug 192 and associated bottom auxiliary pin 132 can be the same as in the previously described embodiment. However, the shell 194 has a smooth bore wall 198 at the larger diameter associated with the auxiliary stack. The lower projection 200 on key 196 rides on this diameter. There is no resistance provided by the lower projection 200, to removal of the key at any rotational position. Only the retentive function of the upper projection 148 in conjunction with the recess in pin 132, retains the key at all rotational positions except the initial, neutral position.

Figure 12:
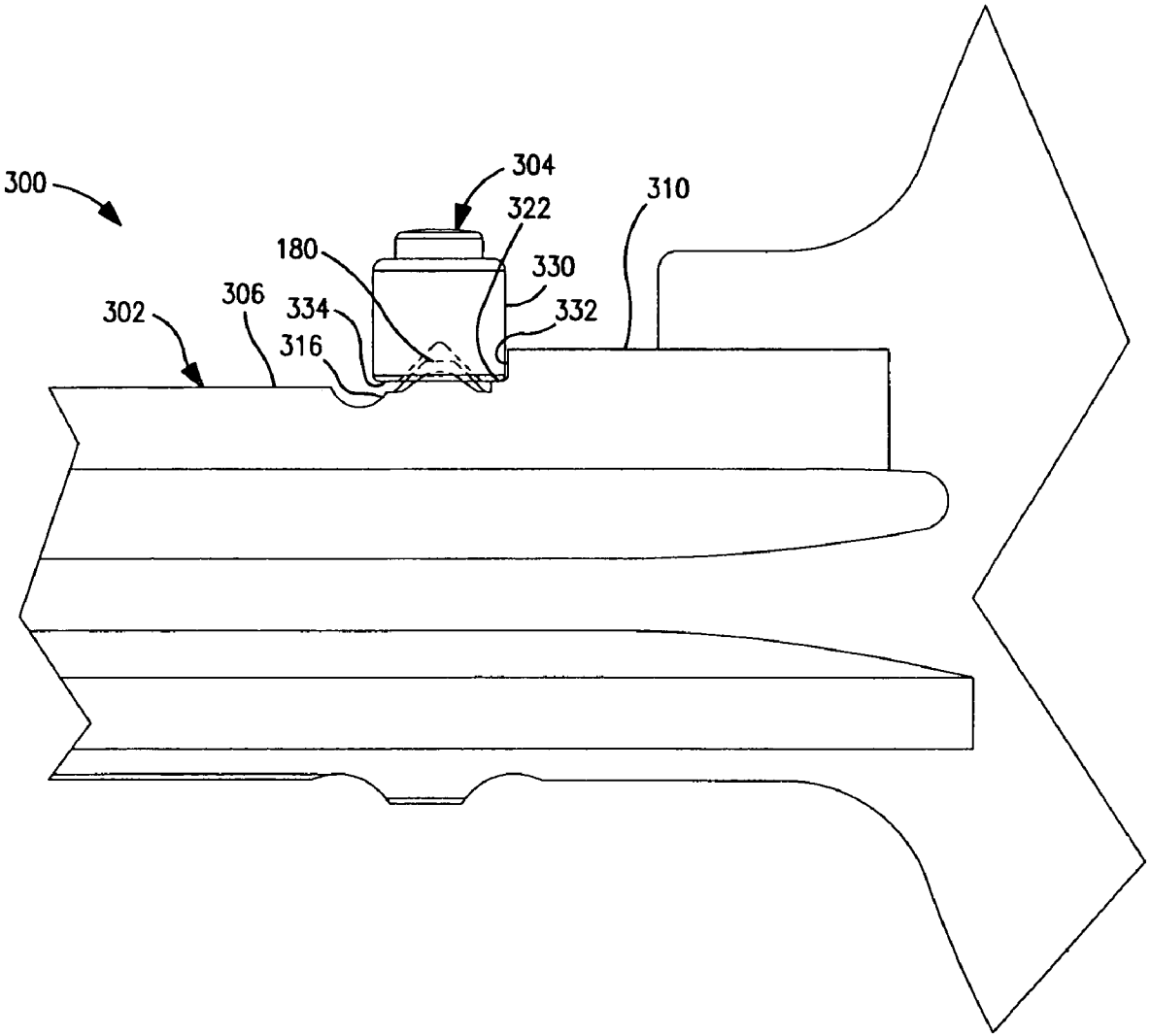
FIGS. 12, 13 and 14 show a respective three embodiments of the improvement in the relationship between the camming projection and shoulder associated with the upper edge of the key blank and the auxiliary bottom pin.
Figure 13:
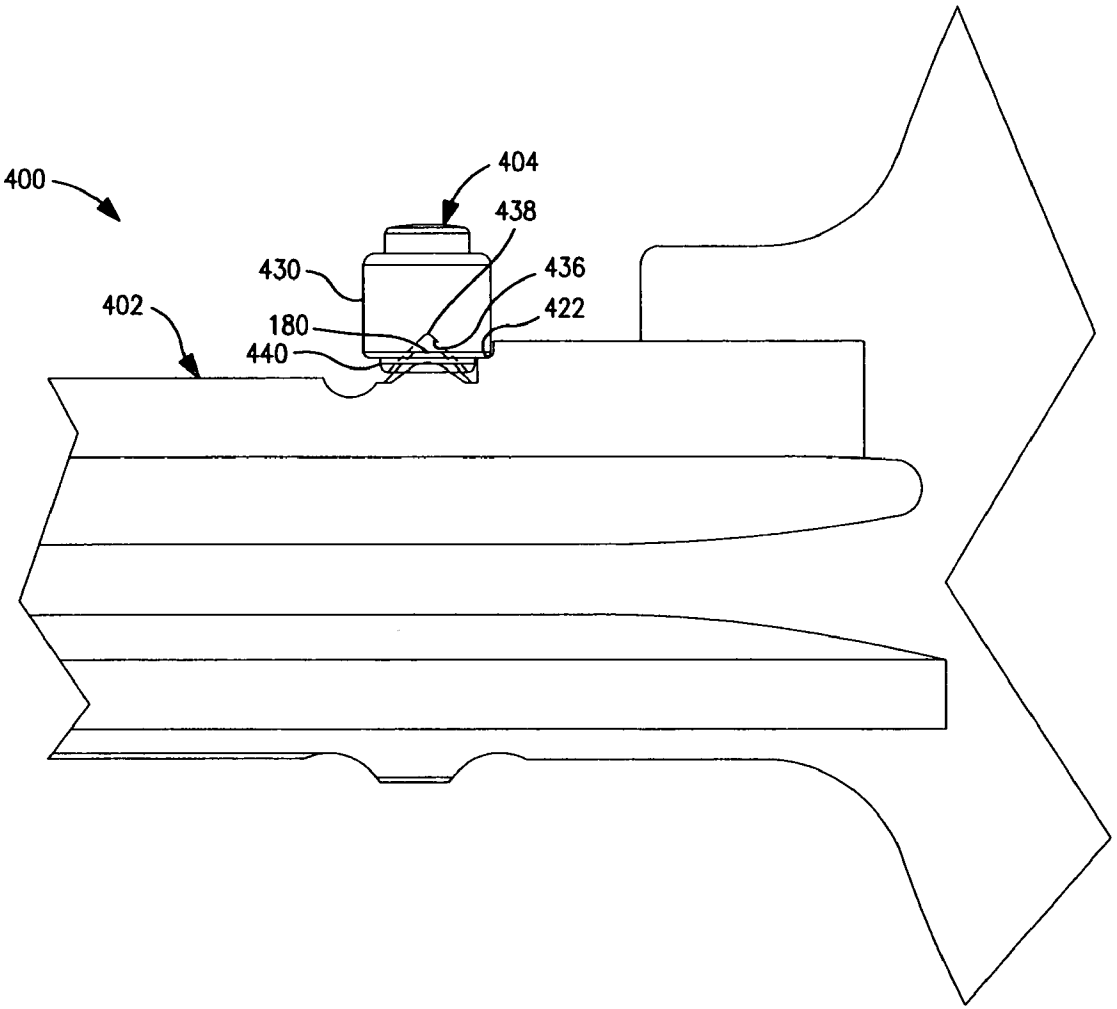
Figure 14:
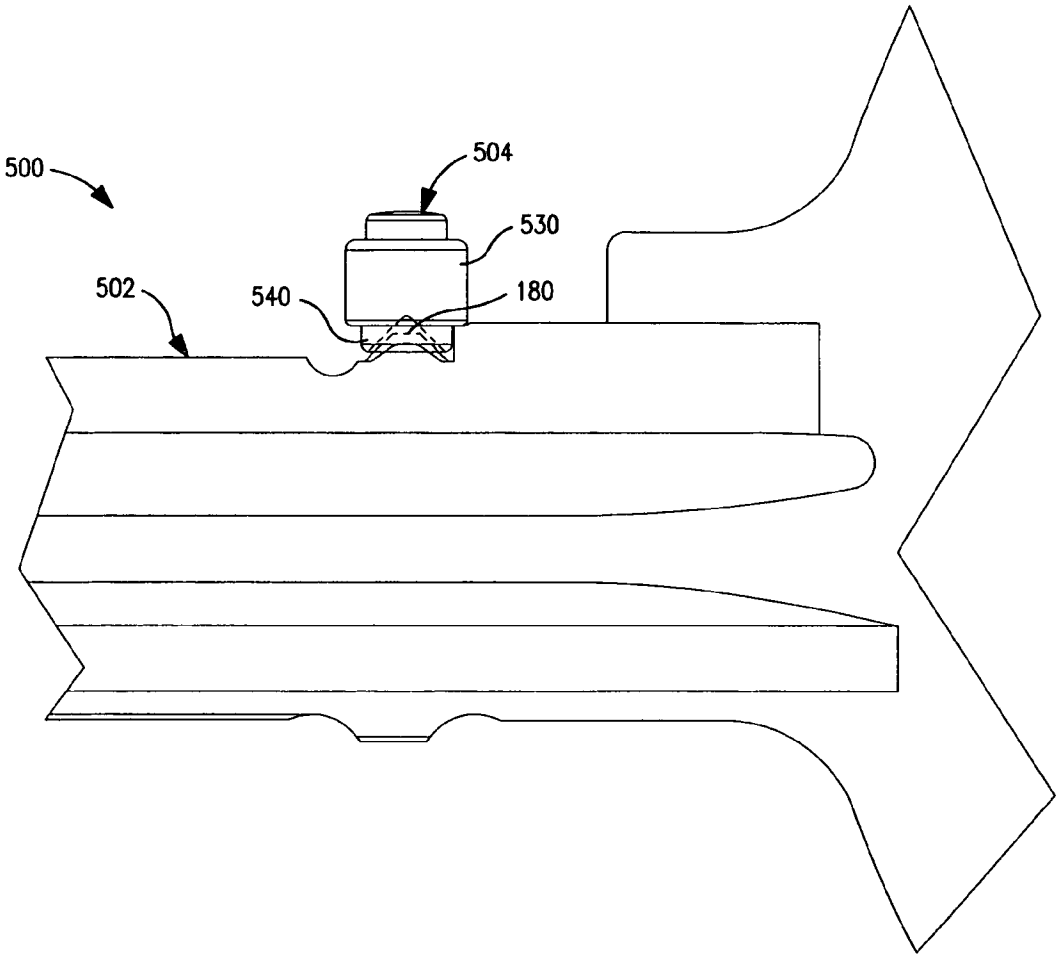
Figure 15:
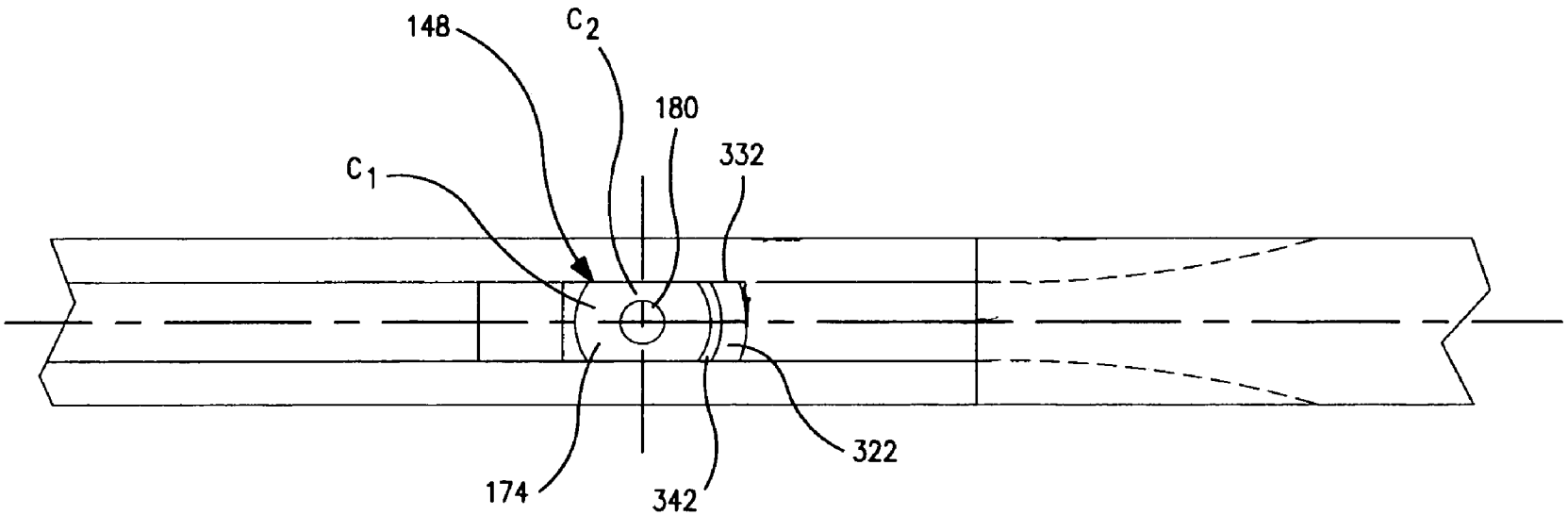
FIG. 15 is a top view of the region of the camming projection, consistent with FIGS. 12-14.
Figure 16:
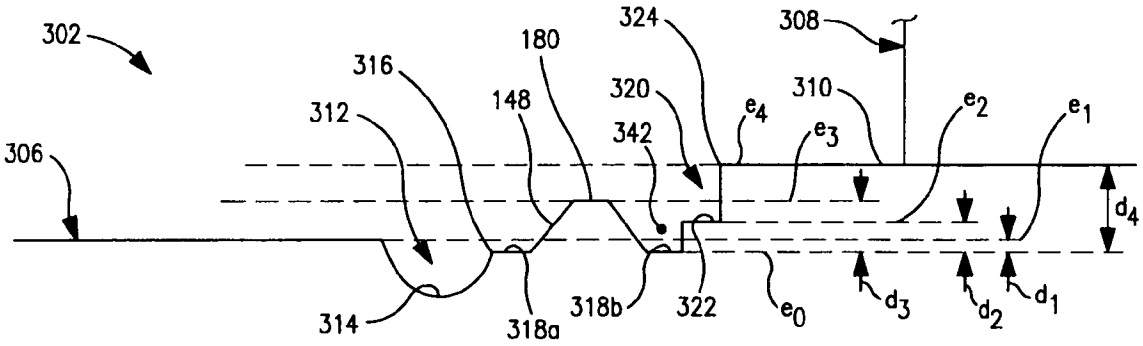
FIGS. 16, 17, and 18 show details of the camming projection and shoulder for the key blanks associated respectively with the embodiments of the key blanks of FIGS. 12, 13 and 14.
Figure 17:
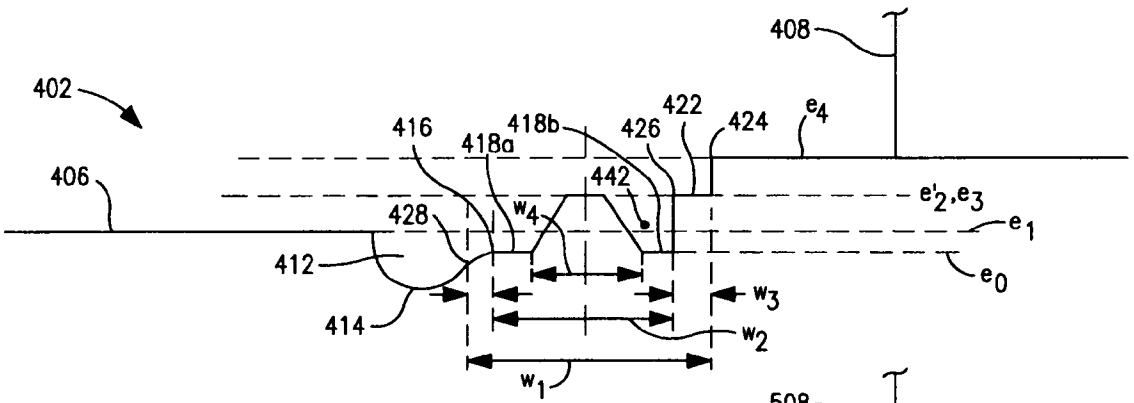
Figure 18:
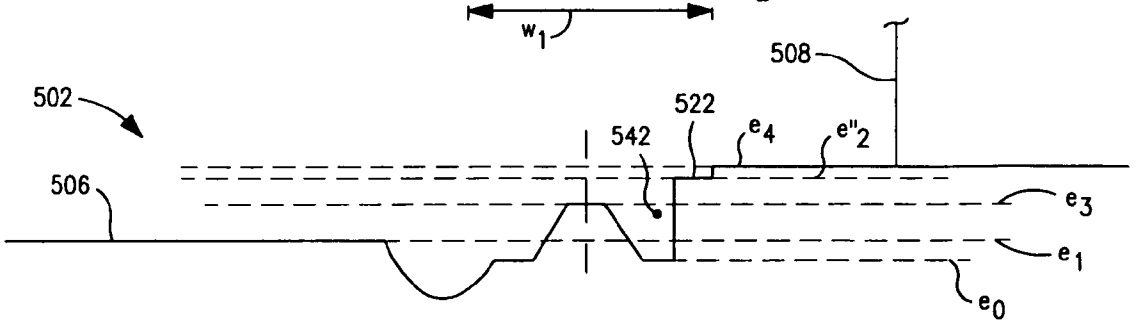

FIGS. 12, 13, and 14 show a respective three embodiments 300, 400, and 500, of a further improvement in the relationship between the camming projection 148 associated with the upper edge 302, 402, and 502 of the key blank and the auxiliary pin 304, 404, and 504. FIG. 15 is a top view of the region of the camming projection, labeled with numeric identifiers for consistency with FIG. 12, but it should be understood that FIG. 15 is also consistent with FIGS. 13 and 14. FIGS. 16, 17 and 18 show details of the key blanks associated respectively with the embodiments of the keys of FIGS. 12, 13 and 14.

With reference now to FIG. 16, many of the common features of the three embodiments will be described, with the understanding that the first digit in the numeric identifier indicates the embodiment whereas to the extent the next two digits are the same, they indicate a structure or feature that is the same or equivalent among the embodiments. With that format in mind, attention is directed to the key blank upper edge 302 that extends from the front edge of bow 308. The upper edge has a camming projection 148 such as described previously, located adjacent the bow 308 but dividing the upper edge 302 into a forward portion 306 and a back portion 310. Preferably, a modified U or similar depression, recess or cut out 312 is locate immediately forward of the projection 148, starting from the corner of the forward portion and dropping to a low point or bottom 314 before rising again to a corner 316 at an elevation below that of the front edge portion 306. At the elevation of corner 316, a front reference surface 318*a* extends substantially horizontally until the projection 148 rises therefrom to a nose 180 at an elevation above the front edge 306. The projection recedes to a back reference surface 318*b* at the same elevation as reference surface 318*a*.

At the front of the bow 308, a notch 320 is formed, facing and spaced from the projection 148, to define a shoulder 322. Preferably, the bow has a vertical edge dropping from corner 324 to define the outer limit of shoulder 322, relative to the centerline of the projection. With reference to FIGS. 17 and 18, the difference among the embodiments 300, 400, and 500 is the elevation of the shoulder 322, 422, 522 relative to surrounding structures. For convenient reference, the elevation of the reference surfaces 318 is indicated as $e_0$; the elevation of the front edge 306 is indicated as $e_1$; the elevation of the shoulder 322 is indicated as $e_2$; the elevation of the top or nose of the projection is indicated as $e_3$; and the elevation of the back edge is indicated as $e_4$. Among the embodiments, the elevation of the shoulder is between $e_1$ and $e_4$. In FIG. 16, $e_2$ is between $e_1$ and $e_3$; in FIG. 17, $e_2'$ is substantially the same as $e_3$; in FIG. 18, $e_2''$ is between $e_3$ and $e_4$.

As an example associated with the embodiment 300, the elevation difference $d_1$ between $e_0$ and $e_1$, can be in the range of 0.005 to 0.010 inch; the elevation difference $d_2$ between $e_0$ and $e_2$ can be in the range of 0.008 to 0.015 inch; the elevation difference $d_3$ between $e_0$ and $e_3$, can be in the range of 0.025 to 0.030 inch; and the elevation difference $d_4$ between $e_0$ and $e_4$ can be in the range of 0.030 to 0.040 inch.

With reference now to FIGS. 12 and 15, it can be seen that the shoulder 322 preferably has a curvature generally corresponding to the curvature of the circumference 300 of the auxiliary pin 304 at the nominal diameter. This appears as a segment of an annulus having straight, rather than radial, sides 330. The curvature is centered on the vertical centerline of the projection 148. As is shown in FIG. 12, the shoulder is shaped to receive and directly supports the rim 334 of the auxiliary pin 304, such that the pin does not rest directly in or on the projection 148, front edge portion 306, or back edge portion 310.

In FIGS. 12,13, and 14, the pins 304, 404, and 504 all have a recess such as 436 that converges to a central apex 438. Preferably, when the rim rests on shoulder 422, the apex 438 is spaced from the nose 180 of the projection in the recess and the apex is at an elevation above the elevation $e_4$ of the back edge portion. In embodiment 300, the rim has an outer diameter that is substantially equal (but for beveling) to the nominal outer diameter 330 of the pin 304. In the embodiment 400, the pin has a short descending cylindrical extension 440 with a rim of smaller than nominal diameter, whereas embodiment 500 has a long cylindrical extension with a rim of smaller than nominal diameter. With the shoulder 322, 422, 522 supporting the pin at the nominal diameter 330, 430, 530, these extensions 440, 540 in embodiments 400 and 500, occupy most of the space 442, 542 between the shoulder and the projection 148. The extension can thus provide a backup stabilizing of the pin should forces arise that would urge the pin away from the shoulder. It can readily be appreciated that the longer the extension on the pin, the higher the elevation $e_2$ of the shoulder 322 to assure that the shoulder supports the pin at the pin nominal diameter.

As shown in FIG. 17, to assure that the pin is supported on shoulder 422, the nominal pin diameter should be greater than the horizontal distance or width $w_2$ defined by the front reference surface 418*a*, the width $w_4$ of the projection 148 at the junction with the reference surfaces, and the back reference surface 418*b*, and less than the diameter $w_1$ defined by the radius from the projection centerline to the radially outer limit of the shoulder 422. The wall extending from the outer limit of the shoulder 422 to the corner 424 of the back portion 410 of the upper edge should be vertical, but contoured to follow the curvature of the pin at the nominal diameter. With embodiments 400 and 500, the rim outer diameter on the extension must not exceed $w_2$, to assure entry into the space between the shoulder 422 and the projection 148. The vertical wall that descends from the corner 426 defining the inner radius of the shoulder 422, is preferably arcuate commensurate with the curvature of the pin extension. The radial width of the shoulder 422 indicated at $W_3$, can be any convenient value.

As shown in FIGS. 12, 13, 14, 15, 16, 17 and 18, the cylinder defined by the nominal diameter 330, 430, 530 of the pin extends forward of the corner 316 where the cut out 312 meets the front reference surface 318*a*, to a position 428 above the upwardly curving portion of the cut out 412. The bottom 414 of the cut out 412 is forward of the projection 148 centerline, by at least the distance from the centerline to the radially outer limit of the shoulder 322 (corresponding to $w_1$). The length of the surface 318*a* between corner 316 and the base of the projection will not be wider than the surface 318*b*. The machining process to create the projection should ensure that there is a smooth transition between recess and corner.

As previously explained in connection with FIG. 8, which closely resembles FIG. 15 except for the shoulder stop 322, the projection 148 has a compound convex profile that converges both longitudinally and transversely toward the nose 180, and thus facilitates entry of the nose into the recess of the auxiliary pin even in the event of slight misalignment. Although the projection viewed along the upper edge toward the bow has a substantially constant width as initially rising from the elevation $e_0$ of the surfaces 318, the contouring approaching the nose 180 from all directions (i.e., longitudinally and transversely, $c_1$ and $c_2$) is smooth and rounded, e.g., having the shape of an annular ring portion of a hemisphere immediately below the nose.

What is claimed is:

1. A key blank for a cylinder lock comprising:

a bow, a blade longitudinally extending from said bow to a tip, and having a longitudinally extending upper edge having a front portion to be cut with coded bitting for mating with a tumbler stack of a cylinder lock and a spaced, longitudinally extending lower edge, and side faces which connect said edges;

upper and lower projections extending outwardly on respective edges adjacent the bow, the upper projection rising about a vertical centerline from a reference elevation $e_0$ below the elevation $e_1$ of the front portion of the upper edge to a nose at an elevation $e_3$ above said elevation $e_1$, and extending a length parallel to the upper edge that is greater than a width transverse to the edge;

wherein said upper projection has a convexly contoured longitudinal cam surface facing the tip of the blade and a convexly contoured longitudinal cam surface facing the bow, which converge toward said nose.

2. The key blank of claim 1, wherein the nose is a flat surface parallel to said upper edge.

3. The key blank of claim 1, wherein said upper projection has convexly contoured transverse cam surfaces that converge toward said nose.

4. The key blank of claim 3, wherein said longitudinal cam surfaces and transverse cam surfaces define an annular portion of a hemisphere immediately below said nose.

5. The key blank of claim 4, wherein the nose is a flat circular surface parallel to said upper edge.

6. The key blank of claim 1, wherein said upper edge includes a back portion extending from the bow at an elevation $e_4$ above elevation $e_3$ of the nose to a notch facing and spaced from the upper projection; and said notch defines a shoulder at elevation $e_2$ between elevations $e_1$ and $e_4$.

7. The key blank of claim 6, wherein the shoulder is a segment of an annular arc centered on the centerline of the upper projection.

8. The key blank of claim 4, wherein said upper edge includes a back portion extending from the bow at an elevation $e_4$ above elevation $e_3$ of the nose to a notch facing and spaced from the upper projection; and said notch defines a shoulder at elevation $e_2$ between elevations $e_1$ and $e_4$.

9. The key blank of claim 8, wherein the shoulder is a segment of an annular arc centered on the centerline of the upper projection.

10. The key blank of claim 6, wherein the elevation $e_2$ of the shoulder is below the elevation $e_3$ of the nose.

11. The key blank of claim 6, wherein the elevation $e_2$ of the shoulder is substantially at the elevation $e_3$ of the nose.

12. The key blank of claim 6, wherein the elevation $e_2$ of the shoulder is above the elevation $e_3$ of the nose.

13. The key blank of claim 6, wherein the upper projection rises from front and back, substantially horizontal reference surfaces at elevation $e_0$; and a recess is provided as a precut on the front portion of the upper edge immediately forward of the front reference surface, said recess having a bottom at an elevation below the reference elevation $e_0$.

14. The key blank of claim 13, wherein the horizontally measured distance from the centerline of the upper projection to the bottom of the recess is at least the horizontally measured distance from said projection centerline to the radially outer limit of said shoulder.

15. A key blank for a cylinder lock comprising:

a bow;

a blade longitudinally extending from said bow to a tip, and having a longitudinally extending upper edge to be cut with coded bitting for mating with a tumbler stack of a cylinder lock and a spaced, longitudinally extending lower edge, and side faces which connect said edges; and an upper projection extending outwardly on said upper edge adjacent the bow, said projection rising from longitudinally extending surfaces at elevation $e_0$ below the elevation $e_1$ of the upper edge, and having a length parallel to the upper edge that is greater than a width transverse to the edge, said projection interposed between a front edge portion to be cut with coded bitting and a back edge portion extending to the bow at elevation $e_4$ above elevation $e_1$;

said projection having cam surfaces converging longitudinally and transversely toward a nose at elevation $e_3$ above elevation $e_1$; and said back edge having a notch forming an arcuate shoulder spaced from the upper projection at an elevation $e_2$ above elevation $e_1$.

16. The key blank of claim 15, wherein said blade has a lower projection, extending outwardly from the lower edge adjacent the bow.

17. The key blank of claim 16, wherein the projections are at least partially vertically aligned.

18. The key blank of claim 15, wherein said upper edge includes a back portion extending from the bow at an elevation $e_4$ above elevation $e_3$ of the nose to a notch facing and spaced from the upper projection; and said notch defines a shoulder at elevation $e_2$ between elevations $e_1$ and $e_4$.

19. The key blank of claim 15, wherein the shoulder is a segment of an annular arc centered on a centerline of the upper projection.

20. The key blank of claim 15, wherein the elevation $e_2$ of the shoulder is below the elevation $e_3$ of the nose.

21. The key blank of claim 15, wherein the elevation $e_2$ of the shoulder is substantially at the elevation $e_3$ of the nose.

22. The key blank of claim 15, wherein the elevation $e_2$ of the shoulder is above the elevation $e_3$ of the nose.

23. A key blank for encoding to operate a coded lock of the type comprising:

a shell having a longitudinal axis, said shell including a first cylindrical portion having a first diameter, at least a first row of primary pin tumbler receiving chambers being located in said first portion, said shell having a second cylindrical portion which is also coaxial with said first portion, said second portion having a second diameter which is greater than said first diameter, an auxiliary pin tumbler receiving chamber being provided in said second portion;

a plug rotatably mounted in said shell, said plug having a face and further having a longitudinally extending keyway formed therein, said keyway having a first portion in registration with said shell first portion and a second portion in registration with said shell second portion, said keyway second portion opening through said face and extending into registration with said shell second portion, said plug also having first and second cylindrical portions of different diameter which are generally complementary to and received in said shell first and second portions, said plug defining at least a first row of cylindrical primary pin tumbler receiving chambers in said first portion thereof, said first row of primary pin tumbler receiving chambers being alignable with said shell primary pin tumbler receiving chambers, said plug defining a cylindrical auxiliary pin tumbler receiving chamber in the said second portion thereof, said auxiliary pin tumbler receiving chamber being alignable with said shell auxiliary pin tumbler receiving chamber, first and second shear lines respectively being defined between said shell and said plug first and second portions; and cylindrical pin tumblers reciprocally mounted in said receiving chambers, said pin tumblers each including at least a bottom pin and a driver pin, said pin tumblers including biasing means for urging a pin of each of said pin tumblers to a position of bridging a shear line when a key is not present in said keyway, wherein the auxiliary bottom pin has a nominal outer diameter and an underside facing said keyway, and said underside has a radially outer rim and a recess within the rim converging to an internal apex;

whereby insertion of a properly bitted key into the keyway displaces said pin tumblers against associated biasing means such that the interfaces between all the bottom and driver pins are located on a shear line;

wherein said key blank comprises:

a bow;

a blade longitudinally extending from said bow to a tip and having a pair of longitudinally extending oppositely disposed and spaced upper and lower edges, the upper edge to be cut with bitting for matching the coding of the [primary tumbler stack] tumblers, and side faces which connect said edges; and a camming projection at the upper edge to be cut, adjacent the bow, said projection rising from a reference elevation $e_0$ below the elevation $e_1$ of the upper edge to a nose at elevation $e_3$ above $e_1$, and having a length parallel to the edge that is greater than a width transverse to the edge, and a longitudinal and transverse cam profile for facilitating entry and removal of the projection into the recess of the auxiliary pin of said lock as the key is fully inserted into or removed from the keyway of said lock;

said upper projection interposed between a front edge portion to be cut with bitting and a back edge portion extending to the bow, at elevation $e_4$ above the elevation $e_3$ of the nose;

said back edge portion having a shoulder at elevation $e_2$ between elevations $e_1$ and $e_4$, for directly supporting said auxiliary tumbler pin at said nominal diameter when a properly coded key from said blank is fully inserted in said keyway and said upper projection is within said recess.

24. The key blank of claim 23, wherein said cam profile is machined with opposed longitudinal cam surfaces which converge toward the nose and opposed transverse cam surfaces which converge toward said nose.

25. The key blank of claim 23, wherein said upper edge portion has a notch spaced from the upper projection; and said notch defines said shoulder at elevation $e_2$ between elevations $e_1$ and $e_4$.

26. The key blank of claim 23, wherein the shoulder is a segment of an annular arc centered on a centerline of the projection.

27. The key blank of claim 23, wherein the elevation $e_2$ of the shoulder is below the elevation $e_3$ of the nose.

28. The key blank of claim 23, wherein the elevation $e_2$ of the shoulder is substantially at the elevation $e_3$ of the nose.

29. The key blank of claim 23, wherein the elevation $e_2$ of the shoulder is above the elevation $e_3$ of the nose.

30. The key blank of claim 23, wherein the projection rises from front and back, substantially horizontally extending reference surfaces at elevation $e_0$; and a recess is provided as a precut on the front portion of the upper edge immediately forward of the front reference surface, said recess having a bottom at an elevation below the reference elevation $e_0$.

31. The key blank of claim 30, wherein the horizontally measured distance from a projection centerline to the bottom of the recess is at least the horizontally measured distance from the projection centerline to the radial outer limit of said shoulder.

32. The key blank of claim 30, wherein the rim of said auxiliary pin has a diameter that is greater than the longitudinal distance defined by the front reference surface, the projection, and the back reference surface.

33. The key blank of claim 32, wherein the rim diameter is equal to the auxiliary pin nominal diameter and the elevation $e_2$ of the shoulder is below the elevation $e_3$ of the nose.

34. The key blank of claim 32, wherein the rim diameter is less than the auxiliary pin nominal diameter and the elevation $e_2$ of the shoulder is substantially at or above the elevation $e_3$ of the nose.

35. The key blank of claim 34, wherein the elevation $e_4$ of said back edge is below the elevation of said apex in the recess of the auxiliary pin when the pin is supported on said shoulder.

36. The key blank of claim 30, wherein the projection as viewed along the edge toward the bow, has a substantially constant width rising from said front reference surface, which then contours transversely inwardly toward the nose.

37. The key blank of claim 30, wherein the shoulder is a segment of an annular arc; and the nominal diameter of the auxiliary pin is greater than the horizontal distance defined by the front reference surface, the projection, and the back reference surface.

38. The key blank of claim 23, wherein said blade has a lower projection, extending outwardly from the lower edge adjacent the bow.

39. The key blank of claim 38, wherein the projections are at least partially vertically aligned.

* * * * *